US006755747B2

(12) United States Patent
Wieser et al.

(10) Patent No.: US 6,755,747 B2
(45) Date of Patent: Jun. 29, 2004

(54) METHOD OF MANUFACTURING AN EXPANSION SLEEVE

(75) Inventors: Jürgen Wieser, Kaufering (DE); Claudia Zimmerer, Augsburg (DE); Heinz Bisping, Augsburg (DE); Alois Koelbl, Buchloe (DE); Erich Daigeler, Waal (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/215,177

(22) Filed: Aug. 7, 2002

(65) Prior Publication Data

US 2003/0060296 A1 Mar. 27, 2003

(30) Foreign Application Priority Data

Aug. 7, 2001 (DE) ..... 101 38 742

(51) Int. Cl.[7] ..... B21D 53/24

(52) U.S. Cl. ..... 470/18; 470/29; 470/30; 470/21

(58) Field of Search ..... 470/18, 25, 26, 470/89, 27, 29, 30, 31, 20, 21; 72/370.06, 370.07

(56) References Cited

U.S. PATENT DOCUMENTS

| | | | | | |
|---|---|---|---|---|---|
| 3,009,177 | A | * | 11/1961 | Carusi et al. | 470/29 |
| 3,247,698 | A | * | 4/1966 | Baldwin et al. | 72/370.03 |
| 4,520,521 | A | * | 6/1985 | Miyake | 470/21 |
| 4,720,224 | A | * | 1/1988 | Peterken | 411/36 |
| 4,968,199 | A | * | 11/1990 | Haage et al. | 411/39 |
| 5,333,980 | A | * | 8/1994 | Pratt et al. | 411/501 |
| 6,048,148 | A | * | 4/2000 | Gassner et al. | 411/54.1 |
| 6,287,044 | B1 | * | 9/2001 | Huber | 403/297 |
| 6,371,708 | B1 | * | 4/2002 | Tresorier | 411/344 |
| 6,447,399 | B1 | * | 9/2002 | Denham | 470/29 |

* cited by examiner

*Primary Examiner*—Ed Tolan
(74) *Attorney, Agent, or Firm*—Sidley Austin Brown & Wood, LLP

(57) ABSTRACT

A method of manufacturing of an expansion sleeve including providing a sleeve blank having axially extending material weaknesses (9), and forming the longitudinal slots (5) by tearing open the material weaknesses (9) by substantially radially expanding same.

6 Claims, 1 Drawing Sheet

Fig. 1
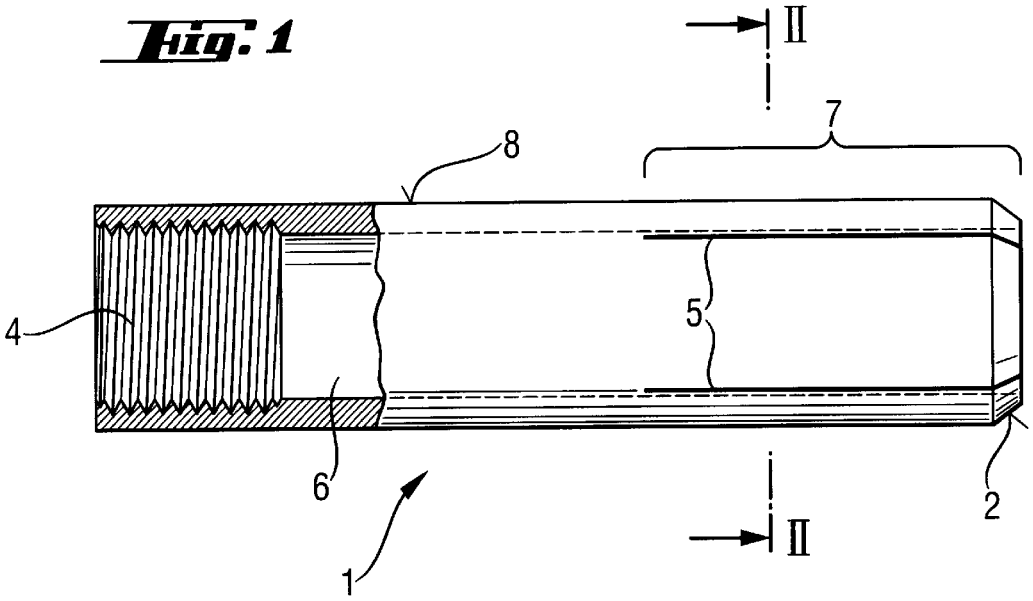
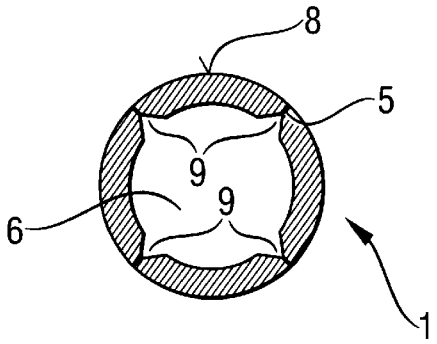
Fig. 2

METHOD OF MANUFACTURING AN EXPANSION SLEEVE

BACKGROUND OF THE INVENTION

1. Field of the Invention

The present invention relates to a method of manufacturing of an expansion sleeve having longitudinal slots, a bore, and a substantially cylindrical outer surface.

2. Description of the Prior Art

Expansion dowels with an expansion sleeve of the type described above are anchored in constructional components formed of concrete, stone, masonry and the like, with the expansion sleeve being radially expanded by an expanding member. The radial expansion is decisive for obtaining target anchoring values. The radial expansion insures frictional and, in certain cases, formlocking anchoring of the expansion dowel in the constructional component. The frictional anchoring or connection depends on the size of the outer profile or surface of the sleeve that frictionally engages the inner surface or wall of the bore in which a dowel is anchored. That is the smaller is the engaging surface of the expansion sleeve the smaller is the anchoring value.

German Publication DE-43 44 382 discloses a method of manufacturing of an expansion sleeve which can be radially expanded. To provide for radial expansion, the expansion region of the expansion sleeve is provided with longitudinal slots, whereby tabs are formed between the slots. The expansion sleeve is radially expanded by introduction of an expansion member into the sleeve bore tapering inward toward the front end of the sleeve. Upon the introduction of the expansion member, the tabs are displaced radially outwardly. After the radial expansion took place, i.e., after the expansion dowel has been completely set, a screw, a threaded rod and the like can be secured to the sleeve which is provided for that purpose with load application means in form of a thread that is located at the end of the sleeve remote from the expansion region. For manufacturing the sleeve, first the longitudinal slots are formed, and then, the tabs are substantially radially compressed to reduce the size of the slots to a most possible extent to provide as large as possible outer surface of the sleeve available for engagement with a bore wall.

The above-described method permits to obtain an expansion dowel advantageous in use but expensive in manufacturing and, therefore, not economical.

Accordingly, an object of the present invention is to provide an economical method of manufacturing of an expansion sleeve that would make the sleeve non-expensive.

Another object of the present invention is to provide a method of manufacturing of a non-expensive expansion sleeve having a large outer surface for engagement with a bore wall.

SUMMARY OF THE INVENTION

These and other objects of the present invention, which will become apparent hereinafter, are achieved by providing a method including providing a blank having axially extending material weaknesses, and forming the longitudinal slots by tearing open the material weaknesses by substantially radially expanding same.

Because the material weaknesses, which form the longitudinal slots, are teared open, the slots have a negligible width so that the sleeve has the maximum possible outer surface available for engagement with a bore wall.

According to an advantageous embodiment of the present invention, the material weaknesses are provided in the wall of the expansion sleeve bore and are formed as sharp, V-shaped grooves. Due to the simple formation of the slots, the method is very economical. Further, the tearing open process permits to obtain slots with complementary opposite teared-open walls.

The tearing open in the region of the material weaknesses is accompanied by heat treatment of this region, which favorably influences the tearing-open process. The selection of a treatment temperature is effected taking into consideration the material of the expansion sleeve. When the sleeve is made of a thermoplastic material, the operational temperatures are below the glass transition temperature. Thus, the temperature, e.g., for tearing open a sleeve formed of a propylene, can be selected below −15° C.

Advantageously, the tearing open is effected by introducing into the bore of the expansion sleeve of a tearing mandrel, an outer diameter of which is greater than an inner diameter of the bore, at least in the region provided with material weaknesses.

The outer surface of the expansion sleeve is advantageously formed by applying to the outer profile of the sleeve of an inwardly directed force. Thereby a substantially cylindrical outer profile is provided insuring the availability of a maximum possible outer surface for engagement with a bore wall. This insures obtaining of an optimal carrying capability of the expansion sleeve in a bore.

Advantageously, the expansion sleeve is formed of a plastic material to insure an economical production of the expansion sleeve. For use under certain condition, e.g., in fireproof locations, the sleeve is formed of metal.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

BRIEF DESCRIPTION OF THE DRAWINGS:

The drawings show:

FIG. 1 a side, partially cross-sectional view of an expansion sleeve formed by the method according to the present invention; and FIG. 2 a cross-sectional view along line II—II in FIG. 1.

DETAILED DESCRIPTION OF THE PREFERRED EMBODIMENT

An expansion sleeve 1, which is shown in FIGS. 1–2, has a radially expandable expansion region 7 with four longitudinal slots 5 uniformly distributed over the circumference of the expansion region 7 and formed so that no clearance is provided between adjacent expansion tabs. At its end remote from the expansion region 7, the expansion sleeve 1 is provided with load application means 4 in form of an inner thread. The longitudinal slots 5 are open at their front ends and extend, at least partially along the expansion sleeve 1. The expansion sleeve I has a central bore 6. The expansion sleeve 1 has a substantially smooth outer surface 8 with an annular bevel 2 at its front end.

During manufacturing, first, a blank of the expansion sleeve 1, which is formed of a plastic material, is produced by injection molding. Advantageously, during the injection molding process, substantially V-shaped, axially extending, material weaknesses 9 are formed in the wall of the bore 6. Thereafter, the longitudinal slots 5 are formed by tearing open the material weaknesses 9 with a tearing mandrel which is introduced into the bore 6. The outer diameter of the tearing mandrel is greater than the inner diameter of the bore 6, and the slots 5 are formed as a result of radial expansion of the material weaknesses 9. In a following production step, a substantially cylindrical outer surface 8 of the expansion sleeve 1 is formed by applying a force acting radially inward.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A method of manufacturing of an expansion sleeve (1) having longitudinal slots (5), a bore (6), and a substantially cylindrical outer surface (8), the method comprising the steps of providing a sleeve-shaped blank having axially extending material weaknesses (9) formed as substantially V-shaped grooves provided in a wall of a blank bore; and forming the longitudinal slots (5) by tearing open the material weaknesses (9) by substantially radially expanding same.

2. A method according to claim 1, wherein the forming step includes heat treatment of regions of the material weaknesses.

3. A method according to claim 1, wherein the forming step includes introducing into the bore (6) of the expansion sleeve (1) of a tearing mandrel, an outer diameter of which is greater than an inner diameter of the bore, at least in a region provided with material weaknesses (9), for radially expanding the material weaknesses.

4. A method according to claim 1, further comprising the step of forming the substantially cylindrical outer surface (8) of the expansion sleeve (1) by applying a radially inwardly acting force.

5. A method according to claim 1, wherein the expansion sleeve (1) is formed of a plastic material, and the blank providing step includes producing the blank by injection molding.

6. A method according to claim 1, wherein the expansion sleeve (1) is produced of metal.

* * * * *